US006688531B2

(12) United States Patent
Sparling et al.

(10) Patent No.: US 6,688,531 B2
(45) Date of Patent: Feb. 10, 2004

(54) METHOD OF AND SYSTEM FOR CONTROLLING AN AIR CONDITIONER

(75) Inventors: Mark Sparling, Fayetteville, NY (US); Kevin J. Porter, Syracuse, NY (US); James Deltoro, Winchester, TN (US); Guy DeLuca, Murfreesboro, TN (US)

(73) Assignee: Carrier Corporation, Farmington, CT (US)

( * ) Notice: Subject to any disclaimer, the term of this patent is extended or adjusted under 35 U.S.C. 154(b) by 147 days.

(21) Appl. No.: 10/080,250

(22) Filed: Feb. 21, 2002

(65) Prior Publication Data

US 2003/0155429 A1 Aug. 21, 2003

(51) Int. Cl.[7] ..... F24F 7/00

(52) U.S. Cl. ..... 236/49.3; 165/250; 165/266; 62/180; 454/256

(58) Field of Search ..... 236/49.1, 49.3; 62/180, 182; 165/248, 249, 250, 251, 252, 266; 454/256, 258

(56) References Cited

U.S. PATENT DOCUMENTS 4,570,448 A * 2/1986 Smith ..... 62/180
4,706,882 A * 11/1987 Barnard ..... 165/266
5,590,540 A * 1/1997 Ikeda et al. ..... 62/180
5,590,830 A * 1/1997 Kettler et al. ..... 454/256

* cited by examiner

*Primary Examiner*—Harry B. Tanner
(74) *Attorney, Agent, or Firm*—Wall Marjama & Bilinski LLP

(57) ABSTRACT

A method and system for staging the cooling effect of an air conditioning unit in which outside air is substantially prevented from passing through the cooling unit for a prescribed time after the cooling function has been initiated.

23 Claims, 3 Drawing Sheets

METHOD OF AND SYSTEM FOR CONTROLLING AN AIR CONDITIONER

BACKGROUND OF THE INVENTION

Many modern structures, especially large buildings, contain interior space that is substantially sealed from the external environment. The air within the interior building space must be conditioned as to temperature and humidity, and usually a minimum amount of oxygen must be supplied to occupants of the building. Fresh, outdoor air may be used to regulate the temperature and humidity within and to supply oxygen to the interior space. For example, if the outdoor air temperature generally is lower than the desired temperature within the building, then the outdoor air may be used to cool the interior space when the temperature within the interior space rises above a desired temperature, or a so-called "set point".

The air temperature may rise within a building due to several sources, such as heat from cooking utensils and light bulbs, sunlight impinging upon floors and walls, radiant heat from exterior walls and windows, and heat generated from building occupants. The amount of heat being generated in the interior space is sometimes referred to as the load of the space.

Air within the interior space of the building should be circulated in order to prevent air from becoming stagnant, which might otherwise allow pockets of extreme temperature difference to develop within the interior space and which might otherwise cause pockets of oxygen-depleted air to develop within the interior space.

It is also usually desirable to maintain the air pressure within the interior space at the same pressure as the outdoor air pressure. Consequently, as fresh, outdoor air is admitted into the interior space, air should usually be discharged in an equal quantity from the interior space into the outdoor environment.

Often, the simple admittance of fresh, outdoor air will be sufficient to maintain the temperature of the interior building space at the set point. However, many times the temperature of the outdoor air, the magnitude of the space load, and the quantity of outdoor air being admitted into the interior space is insufficient to maintain the set point, and the temperature may rise above the set point. In such situations, it is desirable to provide a heat exchanger, much like the cooling coils of a household refrigerator, over which the fresh air, as well as the recirculated interior air, passes before being introduced into the interior space. One or more heat exchangers may be utilized, with the cooling power being increased by the running of additional heat exchangers.

Conventionally, when the temperature of the interior space equals or exceeds a certain number of degrees above set point, the air conditioner is commanded to admit as much outdoor air as possible and to pass all of the outdoor air and the recirculated air past a running heat exchanger, whereby the air being supplied to the interior space is cooled. Under such command, the air being supplied to the interior space may be exceptionally cold and cause discomfort to occupants in the vicinity of air supply ducts. Also under such command, thermostats located near the air supply ducts may falsely suggest that the overall interior of the air space is lower than in reality, and thermostats located remote from air supply ducts may experience a delay in sensing a temperature reduction of the overall interior air space. A remotely located thermostat, such as a thermostat located in the return air duct that supplies air to be recirculated over the heat exchanger, may indicate that the air is at set point while the overall air temperature in the interior space may be significantly below the set point. In either event, when the thermostats sense that set point has been achieved, then they command the heat exchanger to shut down.

Since the cooling fluid in each heat exchanger must be pumped by a compressor, the starting and the stopping of the compressors that pump the cooling fluid through the heat exchangers causes compressor wear and fatigue. With conventional command systems, the compressors are started and stopped relatively frequently, which adversely effects compressor life and increases maintenance and repair costs.

The present invention relates to a system and method of regulating an air conditioner so that it helps ensure that the interior air is cooled to set point, without overcooling, and lessens the frequency with which the compressors are started and stopped, thereby enhancing compressor life and reducing maintenance and repair costs.

SUMMARY OF THE INVENTION

The present invention relates to a method and system for staging the cooling effect of an air conditioning unit in which outside air is substantially prevented from passing through the cooling unit for a prescribed time after the cooling function has been initiated.

BRIEF DESCRIPTION OF THE DRAWINGS

The invention described with reference to the accompanying drawings, wherein.

DESCRIPTION OF A PREFERRED EMBODIMENT

Figure 1:
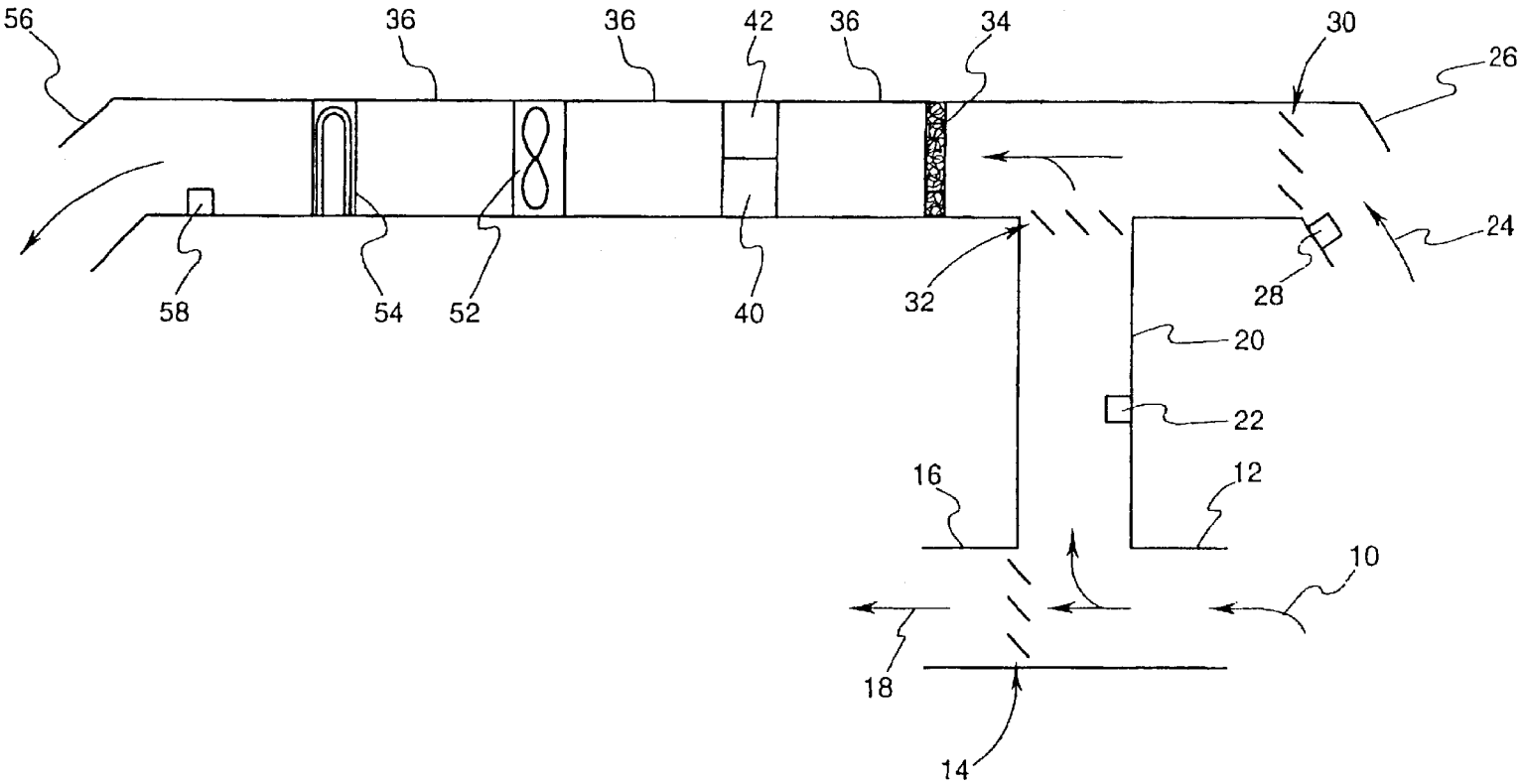
FIG. 1 is a block diagram of a conventional air conditioner that may be utilized in accordance with the present invention.

The following description of a preferred embodiment is for the purpose of explanation, and not limitation. Some specific details are set forth in order to provide a better understanding of a preferred embodiment of the present invention, however, in other instances, description of other elements, features, and techniques are omitted so as not to encumber or confuse the reader with unnecessary detail. It will be apparent to one skilled in the art that the present invention may be practiced in other embodiments that depart from the following description and that differences may exist from the embodiment specifically described without departing from the spirit and scope of the present invention. The following detailed description is therefore not to be taken in a limiting sense.

The present invention will be described with reference to the accompanying drawings, wherein like reference numerals refer to the same item.

There is diagramed in FIG. 1 a conventional air conditioner, called an economizer, for supplying conditioned air to, and exhausting air from, an enclosed space. Return air from the interior space flows in the direction of arrow 10 into a return air duct 12 and may flow through a series of gates or louvers 14 through an exhaust duct 16 to the outdoor environment, as indicated by the arrow 18. Alternatively, the return air may flow through an entrance duct 20 and past a sensor 22 that senses air temperature and humidity, also known as enthalpy. The degree to which the return air passes through the exhaust duct 16 or enters the entrance duct 20 is regulated by the degree to which the louvers 14 are opened or closed.

Fresh, ambient, outdoor air flows in the direction of arrow 24 into an outdoor air entry duct 26 in which is situated a sensor 28 which senses the enthalpy of the outdoor air. A series of louvers 30 are disposed in the outdoor air entrance duct 26, whereby the degree of opening or closing the louvers 30 varies the amount of outdoor air passing through the outdoor air entrance duct 26. This system for admitting outdoor air is usually called an economizer.

As shown in FIG. 1, the return air entrance duct 20 merges with the outdoor air entrance duct 26 downstream of the series of louvers 30. Another series of louvers 32 are disposed at the mouth of the return air entrance duct 20, whereby the degree of opening or closing of the louvers 32 controls the ratio of mixture of return air and outdoor air.

A conventional filter 34 is disposed within a central duct 36, which is located downstream of the return air entrance duct 20 and the outdoor entrance duct 26, whereby any merged outdoor air and return air is filtered of particular matter. Located downstream from the filter 34 in the central duct 36 are one or more heat exchangers, and as shown in FIG. 1, preferably two heat exchangers 40, 42. Although the heat exchangers 40, 42 may be disposed in series within the central duct 36, very preferably they are arranged in parallel, as illustrated in FIG. 1, whereby some of the air traveling through the central duct 36 passes through one heat exchanger 40, and the other portion of the air traveling through the central duct 36 passes through the other heat exchanger 42.

Figure 2:
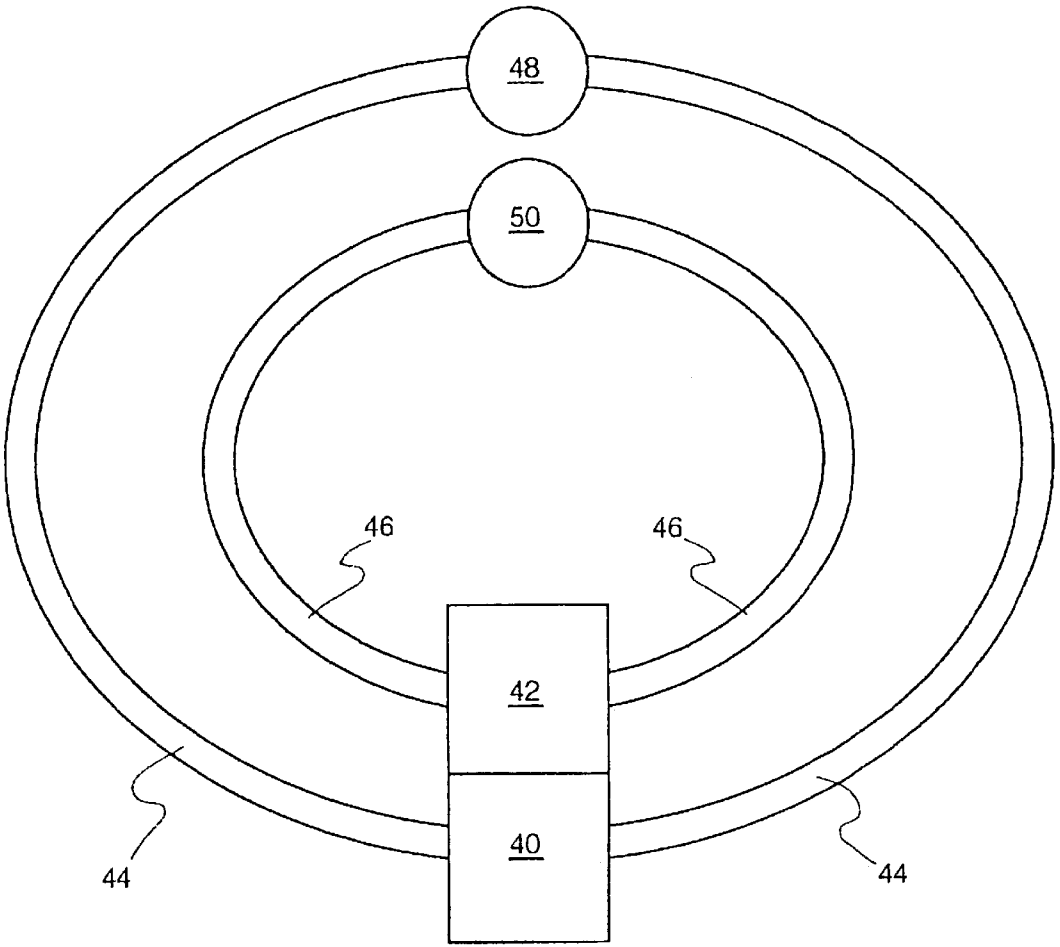
FIG. 2 is a block diagram illustrating a cooling unit comprising two compressors and two heat exchangers in parallel that may be utilized in the air conditioner shown in FIG. 1.

As best shown in FIG. 2, each heat exchanger 40, 42 is operatively connected to a corresponding closed loop 44, 46, respectively, containing cooling fluid. The cooling fluid in each closed loop 44, 46 is circulated by means of a corresponding pump or compressor 48, 50, respectively. Thus, it will be appreciated that in a preferred embodiment, each of the two heat exchangers 40, 42 may be operated independently of the other.

Further downstream from the heat exchangers 40, 42 within the central duct 36 is a fan 52 which draws either outdoor air or return air or both through the central duct 36. Further downstream from the fan 52 are conventional heating elements, which may be used to heat the air passing through the central duct 36, however, the heating elements 54 are not germane to the present invention.

Air travels downstream from the central duct 36 to a discharge or supply air duct 56 and passes a supply air sensor 58, which senses the enthalpy of the supply air delivered to the interior space of a building.

In conventional systems, when the temperature of the return air sensed by the sensor 22 equals or exceeds a predetermined amount above the set point, then the louvers 30 in the outside air supply duct 26 are opened wide and one or more of the compressors 40, 42 are started. As previously stated, this condition may result in an overcooling of the air discharged from the supply air duct 56 such that the area in the vicinity of the supply air duct 56 may be too cool. As cool air continues to be discharged from the supply air duct 56, the interior space will be gradually cooled, which will be sensed by the return air sensor 22. When the temperature sensed by the return air sensor 22 achieves set point, then the compressor or compressors operating one or more of the heat exchangers will be shut down and the cooling effect of the one or more heat exchangers will gradually dissipate. Because of the remote location of the return air sensor 22 from the supply air duct 56, the average temperature of the air in the interior space may be actually significantly lower than the set point, which again results in a general overcooling of the interior space, not just in the vicinity of the supply air duct 56.

Additionally, the compressor or compressors may "cycle off" or shut down because supply air temperature is too low or because the compressor or compressors are pumping cooling fluid too fast. If the supply air temperature is lower than a predetermined temperature, then a safety shut down switch will automatically cause the compressor or compressors to shut down. Likewise, if a pressure sensor (not shown) detects that the pressure level of the cooling fluid is too low, the pressure sensor also triggers a safety shut down switch that shuts down the associated compressor. In some instances, where two compressors are used, the safety shut down switches can cause both compressors to cycle off. Such shut down places stress on the compressor or compressors and also interferes with the delivery of relatively cool supply air.

In accordance with a preferred embodiment of the present invention, the louvers 30 in the outside air supply duct 26 are closed or turned to a minimum open position when the return air sensor 22 senses that the temperature of the return air equals or exceeds a predetermined amount above a set point and causes one of the compressors 40, 42 to be started or enabled to thereby actuate the associated heat exchanger 40, 42. The louvers 30 are maintained at a closed or minimum open position for either a predetermined time interval or until the temperature of the supply air sensed by sensor 58 achieves a predetermined temperature. In a preferred embodiment, the time delay may be about thirty seconds to four minutes. In a preferred embodiment involving interior space in which animals or humans are occupants, preferably the predetermined temperature of the supply air is in the range of about 62° F.–72° F., for example, 68° F. Once the time period expires or the supply air temperature has achieved a predetermined temperature, whichever is sooner, there is another short, predetermined time delay preferably in the range of about thirty seconds to four minutes, and most preferably about three minutes. At the expiration of this second delay, the controller for the air conditioner enables the louvers 30 so that they may be opened relatively gradually, in accordance with conventional operating commands.

The staging routine of the present invention effectively allows the return air sensor 22 to determine what effect one of the compressors and heat exchangers is making, before determining how much the louvers 30 should be opened to augment the cooling effect. As such, the present invention prevents overcooling of the supply air while promoting longer compressor run times and avoiding frequent starting and stopping of the compressor or compressors.

In an embodiment of the invention involving more than one compressor and associated heat exchanger, the same procedure can be utilized to determine whether the second compressor and heat exchanger should be enabled. That is, if the return air sensor 22 continues to detect that the return air has not achieved a set point within a predetermined time interval after the first compressor and heat exchanger have been enabled and after the louvers 30 have been fully opened, then the controller will command the louvers 30 to be shut to a closed or minimum open position and will direct that both compressors be enabled to cause both heat exchangers to be cooled, and the process will be repeated.

In more specific detail, air conditioners such as those previously described are conventionally controlled through a so-called "PID loop", which is an acronym for proportional, integral, and derivative loop. The loop analyzes data from various temperature sensors and runs the data through a standard equation to determine what the desired supply air temperature should be. If the supply air temperature is higher than the calculated, desired temperature, then the louvers 30 may be opened or additional compressors may be enabled. If the actual supply air temperature is lower than the desired, calculated temperature, then the compressors may be disabled or the louvers 30 may be more closed. A standard PID loop equation is as follows: SAT=(error)×(the sum of a proportional term+a starting value+an integral value+a derivative value). The term "SAT" is the supply air temperature. The term "error" is the difference between the return air temperature and the set point. The proportional term is the instantaneous error. The starting value is a selected temperature. The integral value is the average demand over time. The derivative value is the rate of change of the return air temperature over a predetermined, prior time interval.

In accordance with the present invention, the integral value is set to zero when the return air sensor 22 senses that the temperature of the return air equals or exceeds a predetermined amount of the set point.

The present invention can be implemented in existing air conditioning controller systems by retrofitting new computer software or programs into existing controllers.

Figure 3:
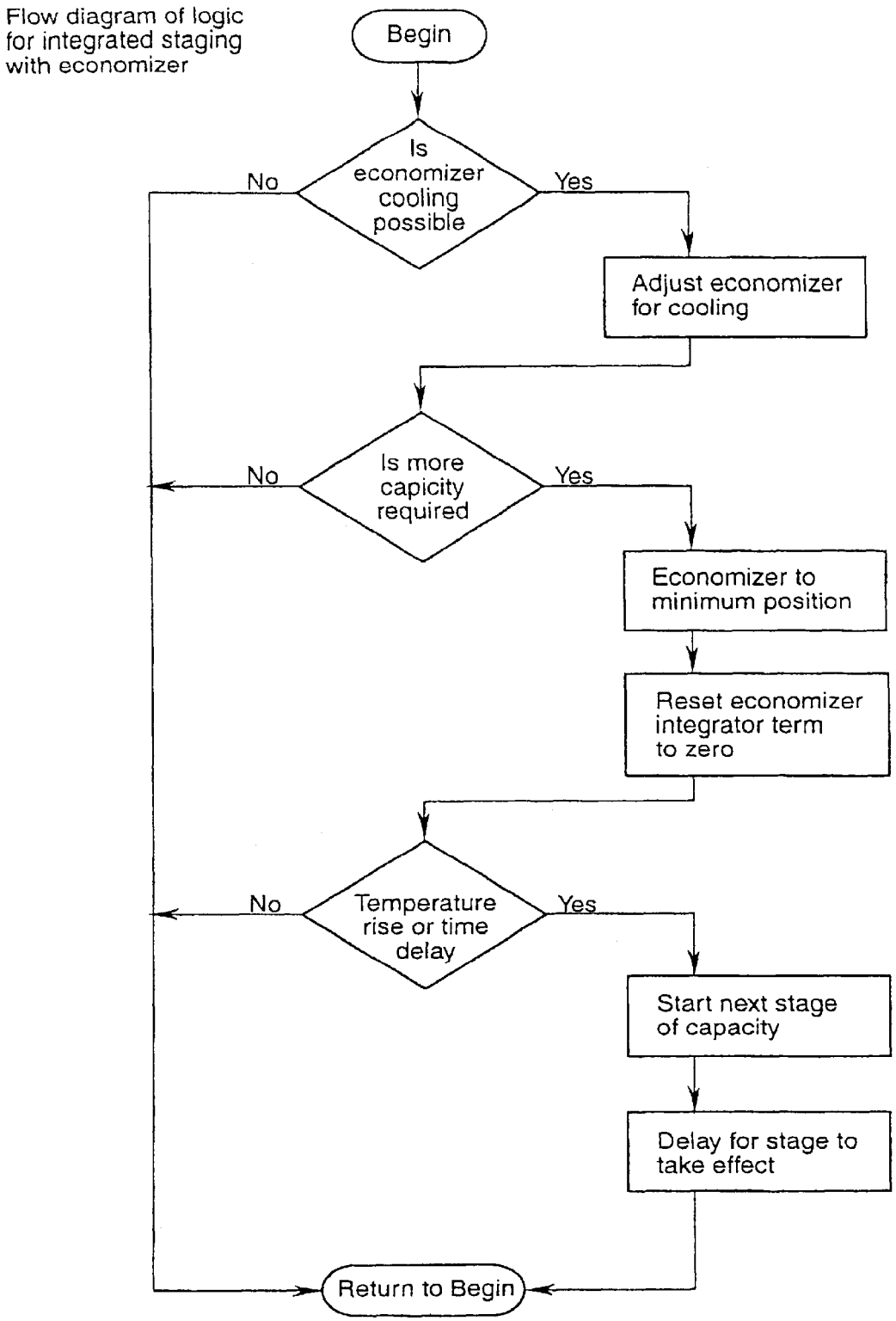
FIG. 3 is a general flow chart of the logic for integrated staging of cooling units in accordance with a preferred embodiment of the present invention.

FIG. 3 depicts a flow chart illustrating the operation of the computer software.

While the invention has been described in conjunction with a preferred embodiment, it is evident that numerous alternatives, variations, and modifications will be apparent to those skilled in the art in light of the foregoing description. Thus, it is understood that the invention is not to be limited by the foregoing illustrative details.

What is claimed is:

1. A method of staging the cooling effect of an air conditioning unit adapted to cool air within a substantially enclosed structure, said unit including an air duct in communication with both the region internal to said structure and the region external to said structure, at least one heat exchanger adapted to cool air substantially within said duct, at least one compressor adapted to pump coolant through an associated one of said at least one heat exchangers, at least one louver disposed substantially within said duct and movable from a fully closed position whereby air from said external region is substantially prevented from moving through said duct to said at least one heat exchanger to a substantially fully open position whereby air from said external region may flow substantially unimpeded through said duct to said at least one heat exchanger, at least one timer, at least one supply air temperature sensor adapted to sense the temperature of air exiting said duct into said internal region, and at least one return air temperature sensor adapted to sense the temperature of air returning to said duct from said internal region, said method comprising the steps of:

(a) establishing a set point temperature for the temperature of air in said internal region;

(b) establishing a triggering temperature which is higher than said set point temperature;

(c) establishing a threshold temperature;

(d) determining the temperature sensed by said at least one return air temperature sensor;

(e) moving said at least one louver to a substantially fully closed position when the temperature sensed by said at least one return air temperature sensor substantially equals or exceeds said triggering temperature;

(f) operationally activating said at least one compressor whereby coolant is pumped to said associated at least one heat exchanger and whereby air within said duct is cooled by said associated at least one heat exchanger when the temperature sensed by said at least one return air temperature sensor substantially equals or exceeds said triggering temperature;

(g) maintaining said at least one louver in a substantially fully closed position for a time period substantially immediately after the temperature sensed by said at least one return air temperature sensor substantially equals or exceeds said triggering temperature and said at least one louver is moved to a substantially closed position and said at least one compressor is operationally activated, said time period substantially calculated by the sum of:

(1) either a first predetermined time interval or the time until when the temperature sensed by said at least one supply air temperature sensor achieves said threshold temperature, whichever is shorter, and (2) a second predetermined time interval; and (h) allowing said at least one louver to move away from said substantially closed position substantially only after said time period has lapsed.

2. A method according to claim 1 wherein said first predetermined time interval is in the range of about thirty seconds to four minutes.

3. A method according to claim 2 wherein said threshold temperature is in the range of about 62° F. to 72° F.

4. A method according to claim 3 wherein said second predetermined time interval is in the range of about thirty seconds to four minutes.

5. A method according to claim 2 wherein said second predetermined time interval is in the range of about thirty seconds to four minutes.

6. A method according to claim 1 wherein said threshold temperature is in the range of about 62° F. to 72° F.

7. A method according to claim 6 wherein said second predetermined time interval is in the range of about thirty seconds to four minutes.

8. A method according to claim 1 wherein said second predetermined time interval is in the range of about thirty seconds to four minutes.

9. A method of staging the cooling effect of an air conditioning unit adapted to cool air within a substantially enclosed structure, said unit including an air duct in communication with both the region internal to said structure and the region external to said structure, at least one heat exchanger adapted to cool air substantially within said duct, at least one compressor adapted to pump coolant through an associated one of said at least one heat exchangers, at least one louver disposed substantially within said duct and moveable from a fully closed position whereby air from said external region is substantially prevented from moving through said duct to said at least one heat exchanger to a substantially fully open position whereby air from said external region may flow substantially unimpeded through said duct to said at least one heat exchanger, at least one timer, at least one supply air temperature sensor adapted to sense the temperature of air exiting said duct into said internal region, and at least one return air temperature sensor adapted to sense the temperature of air returning to said duct from said internal region, said method comprising:

(a) establishing a set point temperature for the temperature of air in said internal region;

(b) establishing a triggering temperature which is higher than said set point temperature;

(c) establishing a threshold temperature;

(d) determining the temperature sensed by said at least one return air temperature sensor;

(e) moving said at least one louver to a substantially fully closed position when the temperature sensed by said at least one return air temperature sensor substantially equals or exceeds said triggering temperature;

(f) operationally activating said at least one compressor whereby coolant is pumped to said associated at least one heat exchanger and whereby air within said duct is cooled by said associated at least one heat exchanger when the temperature sensed by said at least one return air temperature sensor substantially equals or exceeds said triggering temperature;

(g) maintaining said at least one louver in a substantially fully closed position for a time period substantially immediately after the temperature sensed by said at least one return air temperature sensor substantially equals or exceeds said triggering temperature and said at least one louver is moved to a substantially closed position and said at least one compressor is operationally activated, said time period substantially calculated by the sum of:

(1) either a first predetermined time interval or the time until when the temperature sensed by said at least one supply air temperature sensor achieves said threshold temperature, whichever is shorter; and (2) a second predetermined time interval; and (h) allowing said at least one louver to move away from said substantially closed position substantially only after said time period has lapsed.

10. A method according to claim 9 wherein said first predetermined time interval is on the range of about thirty seconds to four minutes.

11. A method according to claim 10 wherein said threshold temperature is on the range of about 62° F. to 72° F.

12. A method according to claim 11 wherein said second predetermined time interval is in the range of about thirty seconds to four minutes.

13. A method according to claim 10 wherein said second predetermined time interval is in the range of about thirty seconds to four minutes.

14. A method according to claim 9 wherein said threshold temperature is on the range of about 62° F. to 72° F.

15. A method according to claim 14 wherein said second predetermined time interval is in the range of about thirty seconds to four minutes.

16. A method according to claim 11 wherein said second predetermined time interval is in the range of about thirty seconds to four minutes.

17. A system for staging the cooling effect of an air conditioning unit adapted to cool air within a substantially enclosed structure, said unit including:

(a) an air duct in communication with both the region internal to said structure and the region external to said structure;

(b) at least one heat exchanger adapted to cool air substantially within said duct;

(c) at least one compressor adapted to pump coolant through an associated one of said at least one heat exchangers;

(d) at least one louver disposed substantially within said duct and moveable from a fully closed position whereby air from said external region is substantially prevented from moving through said duct to said at least one heat exchanger to a substantially fully open position whereby air from said external region may flow substantially unimpeded through said duct to said at least one heat exchanger;

(e) at least one timer;

(f) at least one supply air temperature sensor adapted to sense the temperature of air exiting said duct into said internal region;

(g) at least one return air temperature sensor adapted to sense the temperature of air on said internal region returning to said duct;

(h) control means for:

(1) establishing a set point temperature for the temperature of air on said internal region;

(2) establishing a triggering temperature which is higher than said set point temperature;

(3) establishing a threshold temperature;

(4) determining the temperature sensed by said at least one return air temperature sensor;

(5) moving said at least one louver to a substantially fully closed position when the temperature sensed by said at least one return air temperature sensor substantially equals or exceeds said triggering temperature;

(6) operationally activating said at least one compressor whereby coolant is pumped to said associated at least one heat exchanger and whereby air within said duct is cooled by said associated at least one heat exchanger when the temperature sensed by said at least one return air temperature sensor substantially equals or exceeds said triggering temperature;

(7) maintaining said at least one louver in said substantially fully closed position for a time period substantially immediately after the temperature sensed by said at least one return air temperature sensor substantially equals or exceeds said triggering temperature and said at least one louver is moved to a substantially closed position and said at least one compressor is operationally activated, said time period substantially calculated by the sum of:

(a) either a first predetermined time interval or the time until when the temperature sensed by said at least one supply air temperature sensor achieves said threshold temperature, whichever is shorter, and (b) a second predetermined time interval; and (8) allowing said at least one louver to move away from said substantially closed position substantially only after said time period has lapsed.

18. A method of staging the cooling effect of an air conditioning unit adapted to cool air within a substantially enclosed structure, said cooling unit adapted to permit air from outside said structure to pass through the cooling unit and enter the interior of said structure, said method comprising the steps of:

(a) initiating the cooling function of the cooling unit;

(b) substantially preventing air from outside said structure from passing through said cooling unit for a time period commencing substantially upon initiating said cooling function, said time period calculated according to at least one preselected criteria, (c) wherein said at least one preselected criteria is selected from the group consisting of at least one predetermined time interval and the temperature of air exiting said cooling unit.

19. A method according to claim 18 wherein at least one of said at least one predetermined time interval is in the range of about thirty seconds to four minutes.

20. A method of staging the cooling effect of an economizer controlled substantially through a PID loop comprising the steps of:

(a) initiating the cooling function of the economizer;

(b) substantially preventing outside air from entering said economizer for a time period commencing substantially upon initiating said cooling function, said time period calculated according to at least one preselected criteria; and (c) permitting outside air to enter said economizer after said time period, (d) wherein said at least one preselected criteria is selected from the group consisting of at least one predetermined time interval and the temperature of air exiting said cooling unit.

21. A method according to claim 20 wherein said at least one of said at least one predetermined time interval is in the range of about thirty seconds to four minutes.

22. An economizer including means for regulating the amount of outside air that enters the economizer, said economizer including:

(a) control means operatively connected to said regulating means and adapted to automatically command said regulating means to substantially prevent outside air from entering the economizer for a time period commencing substantially upon the initiation of the cooling function of said economizer, said time period calculated according to at least one preselected criteria, (b) wherein said at least one preselected criteria is selected from the group consisting of at least one predetermined time interval and the temperature of air exiting said economizer.

23. An economizer according to claim 22 wherein at least one of said at least one predetermined time interval is in the range of about thirty seconds to four minutes.

* * * * *